US005681253A

United States Patent [19]

Owen et al.

[11] Patent Number: 5,681,253

[45] Date of Patent: Oct. 28, 1997

[54] HIGH SPEED FOUR-WAY CARTON END CLOSURE SCORE LINE BREAKER ASSEMBLY

[75] Inventors: Barry C. Owen, Southfield; Randy D. Jackson, Royal Oak, both of Mich.

[73] Assignee: Elopak Systems A.G., Glattbrugg, Switzerland

[21] Appl. No.: 625,942

[22] Filed: Apr. 1, 1996

Related U.S. Application Data

[62] Division of Ser. No. 295,432, Aug. 25, 1994, Pat. No. 5,538,491.

[51] Int. Cl.[6] ..... B31B 1/52

[52] U.S. Cl. ..... 493/183; 493/184; 493/452; 493/454; 493/370; 493/165

[58] Field of Search ..... 483/183, 184, 483/452, 453, 454, 60, 70, 71, 72, 360, 370, 164, 165, 408, 409; 53/374, 378

[56] References Cited

U.S. PATENT DOCUMENTS

| | | | |
|---|---|---|---|
| 3,398,659 | 8/1968 | Egleston | 93/44.1 |
| 3,452,653 | 7/1969 | Berney | 93/84 |
| 3,943,834 | 3/1976 | Vetten | 93/44.1 GT |
| 3,999,469 | 12/1976 | Nilsson | 93/36.8 |
| 4,215,522 | 8/1980 | Clift et al. | 53/378 |
| 4,337,059 | 6/1982 | Allen et al. | 493/184 |
| 4,519,181 | 5/1985 | Sherman et al. | 53/374 |
| 4,589,862 | 5/1986 | Murrah | 493/183 |
| 4,738,077 | 4/1988 | Wakbayashi et al. | 53/375 |
| 4,788,811 | 12/1988 | Kawajiri et al. | 53/426 |
| 5,167,607 | 12/1992 | Larsen | 493/183 |

FOREIGN PATENT DOCUMENTS

| | | |
|---|---|---|
| 452736 | 12/1987 | Sweden . |
| 1036320 | 7/1966 | United Kingdom . |
| WO82/03834 | 11/1982 | WIPO . |

*Primary Examiner*—Eileen Morgan

*Attorney, Agent, or Firm*—Reising, Ethington, Barnard & Perry, PLLC

[57] ABSTRACT

A carton score line breaker assembly for breaking four end closure panels. The assembly includes two oppositely disposed pairs of breaker elements for, in turn, breaking the two oppositely disposed panels inwardly. Both pairs of elements are continuously rotating.

7 Claims, 2 Drawing Sheets

HIGH SPEED FOUR-WAY CARTON END CLOSURE SCORE LINE BREAKER ASSEMBLY

This is a division of application Ser. No. 08/295,432, filed on Aug. 25, 1994.

FIELD OF THE INVENTION

This invention relates generally to apparati for pre-breaking plastic coated four-sided cardboard carton end closure panels along scorelines formed between the four end panels and the carton's four side panels, and, more particularly, to such apparati having components operative on all four sides during one indexed position of the carton, including two oppositely disposed, continuously revolving pairs of breaker elements.

BACKGROUND ART

While numerous oscillating carton bottom score line breakers exist, the following three patents disclose known continuous motion bottom score line breaker mechanisms.

Egleston U.S. Pat. No. 3,398,659 discloses a machine including continuous motion mandrels having tubular cartons mounted thereon and rotatable past spindles which are continuously rotating around fixed axes. The spindles have fingers or wings mounted thereon for breaking oppositely disposed side closure panels, along with blades for closing the trailing closure panel. A stationary teflon coated camming shoe closes the leading closure panel.

Murrah U.S. Pat. No. 4,589,862 is somewhat similar to U.S. Pat. No. 3,398,659 in operation, but, additionally, includes a disk roller rotatably mounted on the distal end of each of a pair of continuously rotating blades to eliminate possible marring of the end surface observed by consumers.

Swedish patent no. 452,736 discloses two pair of dual legs continuously rotating to function similarly to the U.S. Pat. No. 3,398,659 arrangement to break the opposite side and trailing panels, in conjunction with a pair of camming rails for closing the leading panel of a moving carton.

Sherman et al U.S. Pat. No. 4,519,181 discloses an arrangement for closing both flat ends of a continuous moving filled carton (no mandrel), including tucking fingers, flap folding rods, folding plates, and compression bars.

Patents disclosing reciprocatory pivotal elements for pre-breaking the oppositely disposed pairs of end closure panels include Vetten U.S. Pat. No. 3,943,834; Nilsson U.S. Pat. No. 3,999,469; Clift et al U.S. Pat. No. 4,215,522; Allen et al U.S. Pat. No. 4,337,059; Makbayashi et al U.S. Pat. No. 4,738,077; and Larsen U.S. Pat. No. 5,167,607.

DISCLOSURE OF THE INVENTION

A general object of the invention is to provide an improved high speed, four-sided pre-breaker assembly for paperboard carton end closure panels.

Anther object of the invention is to provide a four-sided carton end closure pre-breaker assembly having two pairs of oppositely disposed elements operative at one indexed position of each mandrel and its associated carton.

A further object of the invention is to provide such a four-sided pre-breaker assembly wherein both oppositely disposed pairs of breaker elements are continuously rotating.

These and other objects and advantages will become more apparent when reference is made to the following drawings and the accompanying description.

BEST MODE OF CARRYING OUT THE INVENTION

Figure 1:
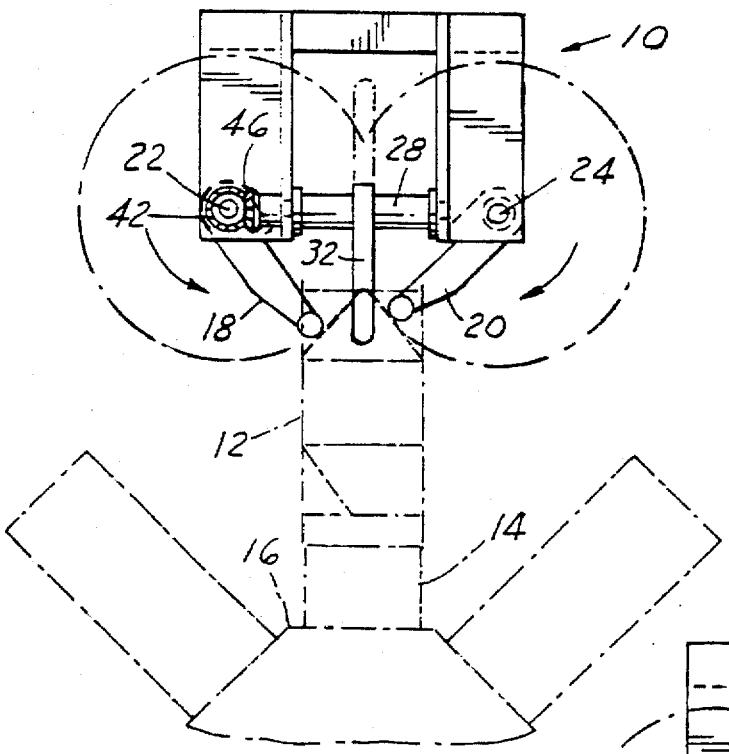
FIG. 1 is a side elevational view of a carton end closure pre-breaking apparatus embodying the invention.
Figure 2:
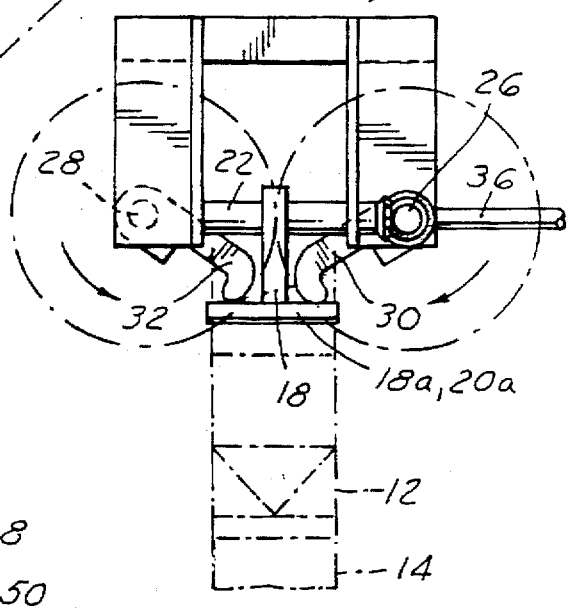
FIG. 2 is an end view of the FIG. 1 structure.
Figure 3:
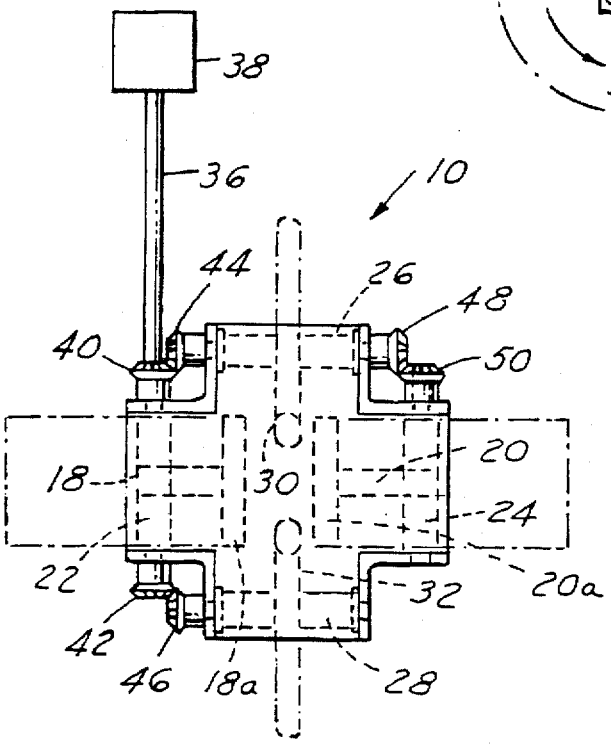
FIG. 3 is a top view of the FIGS. 1 and 2 structure.

Referring now to the drawings in greater detail, FIGS. 1–3 illustrate a continuous motion four-way carton bottom breaker assembly 10 positioned adjacent a tubular carton 12 mounted around a mandrel 14 of an indexing turret 16, the carton 12 having been removed from a magazine (not shown, squared into the tubular shape, and loaded onto the mandrel 14 in a conventional manner.

The bottom breaker assembly 10 includes a first pair of oppositely disposed fingers 18 and 20, having bars 18A and 20A secured to the respective ends thereof, (FIG. 1) continuously rotating at a constant velocity on respective shafts 22 and 24 in the plane of rotation of the turret 16. The bottom breaker 10 further includes a second pair of oppositely disposed fingers 30 and 32 (FIG. 2) continuously rotating at a constant velocity on respective shafts 26 and 28 transversely to the plane of rotation of the turret 16.

As shown in FIG. 3, the shafts 22, 24, 26 and 28 are rotatably mounted adjacent the respective ends of a +shaped bracket 34. The shaft 22 is the driving shaft, having an extension 36 extending to a suitable drive unit, represented as 38.

Pinion gears 40 and 42 are mounted on the ends of the shaft 22. The gear 40 meshes with a pinion gear 44 on an end of the shaft 26. The gear 42 meshes with a pinion gear 46 on an end of the shaft 28. A pinion gear 48 on the other end of the shaft 26 meshes with a pinion gear 50 on an end of the shaft 24.

In operation, the extension 36, the shaft 22, and the gears 40 and 42 are rotated in a counterclockwise direction by the drive unit 38 one complete revolution per machine cycle, driving the gears 44 and 46, and the respective shafts 26 and 28 in respective clockwise and counterclockwise directions. The gear 48 drives the gear 50 and shaft 24 in a clockwise direction.

As shown in FIG. 1, the fingers 18 and 20 on the respective shafts 22 and 24 are thus caused to rotate in respective counterclockwise and clockwise directions. The finger 18 is mounted on the shaft 22 such that it trails the finger 20 so as to not collide at their closest center positions during their rotations. The fingers 30 and 32 are mounted on the respective shafts 26 and 28 so as to lead the fingers 18 and 20, without colliding therewith.

The timing of the fingers 18, 20, 30 and 32 is such that clearance is provided to permit each carton 12 and mandrel 14 to be indexed into and out of the continuous motion bottom breaker assembly 10.

Figure 4:
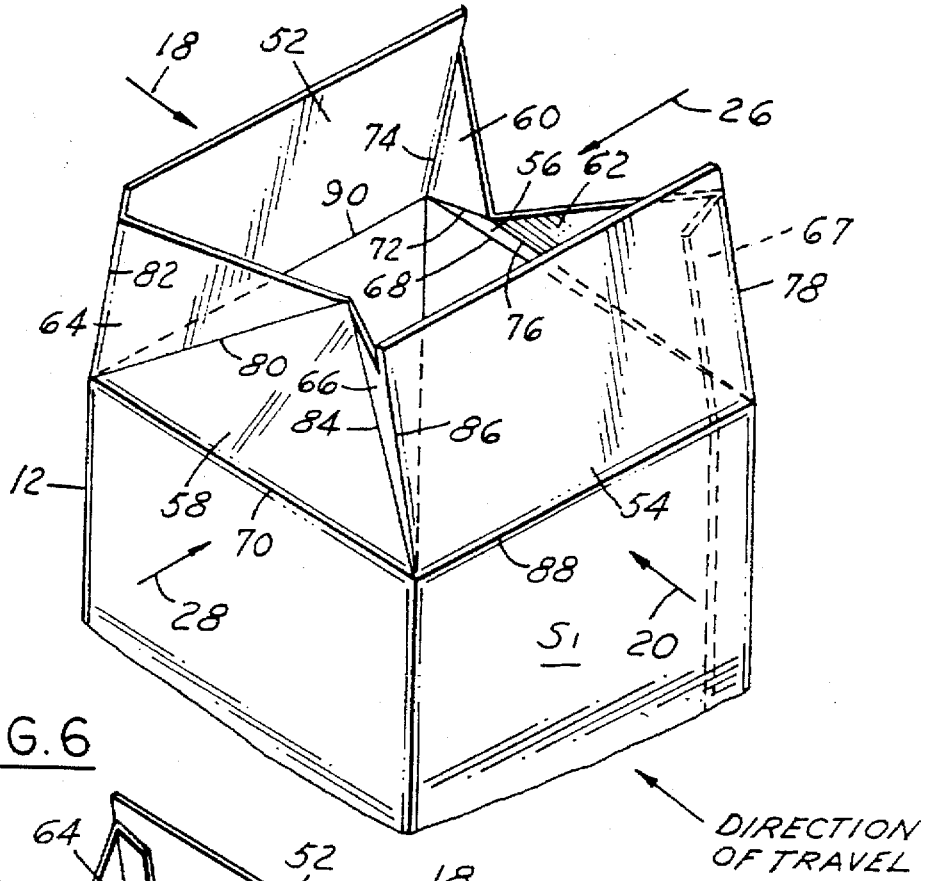
FIG. 4 is an enlarged fragmentary perspective view of the carton, relative to its direction of travel, illustrating its end closure panels after having been pre-broken by the FIGS. 1, 2 and 3 structure.

Referring now to FIG. 4, it is noted that the container 12 includes the usual outer rectangular bottom end panels 52 and 54, and triangular fold-in panels 56 and 58. Triangular panels 60 and 62 connect between the panel 56 and the respective panels 52 and 54, and triangular panels 64 and 66 connect between the panel 58 and the respective panels 52 and 54. A standard side seam or fifth panel 67 is secured to the edge portions of the rectangular bottom end panel 54 and the adjacent side panel $S_1$. All of the panels 52–66 extend beyond the distal end of the mandrel 14 prior to being indexed into position within the breaker assembly 10.

It is the fingers 30 and 32 which rotate against the respective triangular panels 56 and 58, folding them inwardly about respective score lines 68 and 70. The panels 60 and 62 are thereby caused to fold about score lines 72/74 and 76/78, respectively, and the panels 64 and 66 are caused to fold about score lines 80/82 and 84/86, respectively. The bars 20A and 18A on the fingers 20 and 18 rotate, in turn, against the rectangular panels 54 and 52, folding them inwardly about respective score lines 88 and 90. Thus all the score lines are pre-broken, and subsequent closing and sealing is efficiently performed by conventional means.

Figure 6:
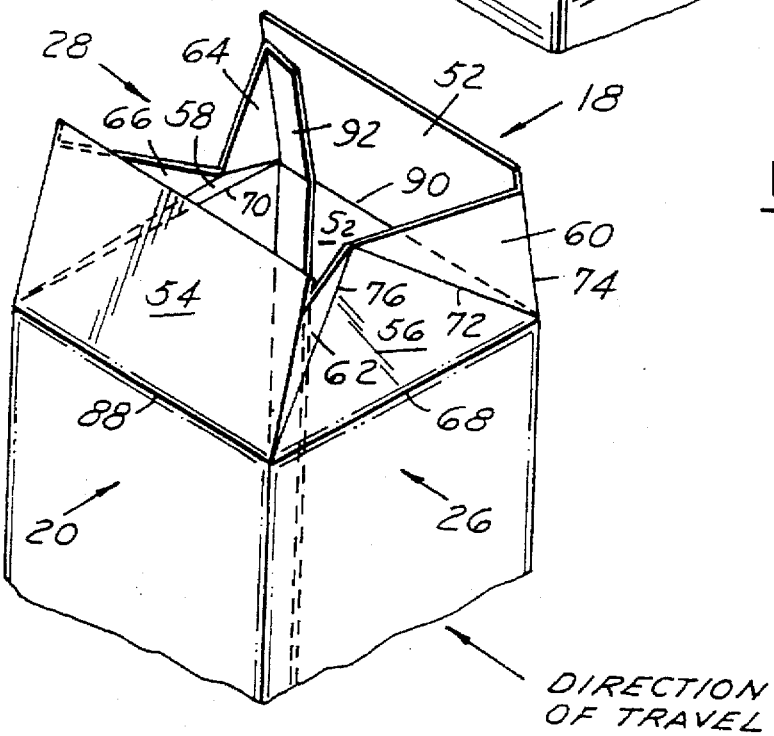
FIG. 6 is a fragmentary perspective view of a different configuration of a carton illustrating its end closure panels after having been pre-broken by the FIGS. 1, 2 and 5 structure.

As shown in FIG. 6, it is noted that a, so-called, reverse side seam or fifth panel 92 is secured to the edge portions of the carton side panels. The relationship to the FIG. 4 carton is such that the top closure arrangement, which is not shown, is in the same orientation for each of the bottom closure arrangements of FIGS. 4 and 6.

Figure 5:
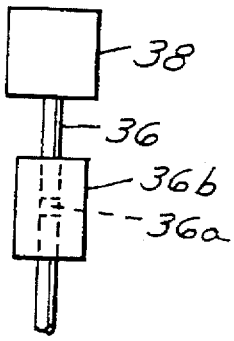
FIG. 5 is a fragmentary view illustrating an alternate embodiment of a portion of the FIG. 4 structure.

Referring now to FIG. 5, a modification of the shaft 36 of FIG. 3 is such that it is split at 36*a*, with the adjacent ends being operatively mounted in a suitable coupling 36*b*. The latter thus serves to permit the entire bottom breaker assembly 10, up to the split 36*a*, to be physically rotated so as to accommodate the new position of the bottom panels 52, 54, 56 and 58, during the bottom folding and sealing process, with no further machine changes being required beyond the mandrel 14 for the top closure forming, filling, and sealing processes.

INDUSTRIAL APPLICABILITY

It should be apparent that the invention provides an improved pre-breaker arrangement which is operative on all four sides of a carton's end closure panels at one indexed position of each mandrel and its tubular carton, and is readily adaptable to either a standard or a reverse fifth panel carton arrangement.

It should be further apparent that the invention is particularly suitable for high speed machines since the fingers of the pre-breakers continuously rotate.

While but two embodiments of the invention have been shown and described, other modifications thereof are possible within the scope of the following claims.

What is claimed is:

1. A method of forming an end closure of one end of a rectangular tubular carton, comprising mounting said carton around an indexable mandrel with four end panels extending beyond an end of said mandrel, indexing said mandrel and thus said carton to a forming station at which said mandrel and said carton attain an indexed position within the forming station, and operating a pair of oppositely disposed forming elements at said station to contact and urge inwardly two dwelling, oppositely disposed, end panels at said one end, characterized in that each forming element of said pair of oppositely disposed forming elements is continually rotated unidirectionally, wherein the forming elements, while acting upon said carton end panels, continually turn about respective paths which intersect the longitudinal axis of said carton.

2. A method according to claim 1, wherein the forming elements, while acting upon said carton, continually turn about respective axes substantially perpendicular to a longitudinal axis of said carton.

3. A method according to claim 1, and further comprising operating a second pair of oppositely disposed forming elements at said station to contact and urge inwardly another two dwelling, oppositely disposed, end panels at said one end, characterized in that each forming element of said second pair of oppositely disposed forming elements is continually rotated unidirectionally.

4. A method according to claim 3, wherein the forming elements of said second pair, while acting upon said carton, continually turn about respective axes substantially perpendicular to the first-mentioned respective axes and said longitudinal axis.

5. A method according to claim 4 and turning through a right-angle both pairs of oppositely disposed forming elements as a unit.

6. A method of operating a packaging machine comprising an end closure forming station, comprising indexing through said forming station a series of cartons having four side panels with standard side seams secured to one of the side panels and, while each carton dwells at said forming station, operating a forming assembly to cause forming elements thereof to act upon end panels of the carton, characterized by effectively turning said forming elements on respective shafts through a right-angle about an axis of said station, and subsequently indexing through said forming station a series of cartons with reverse side seams secured to a different one of the side panels and, while each of the latter cartons dwells at said forming station, operating said forming assembly to cause said forming elements thereof to act upon end panels of the carton, wherein said effectively turning comprises physically rotating said respective shafts from a position accommodating said cartons with standard side seams to another position so as to accommodate said cartons with reverse side seams.

7. A method according to claim 6, wherein said effectively turning comprises turning said forming assembly through a right-angle about said axis of said station.

* * * * *